US007833132B2

(12) United States Patent
Hylbert et al.

(10) Patent No.: US 7,833,132 B2
(45) Date of Patent: Nov. 16, 2010

(54) TRAMPOLINE WITH INFLATED BASE

(75) Inventors: Jon Patton Hylbert, Los Gatos, CA (US); Donald Wayne Strasser, Los Gatos, CA (US)

(73) Assignee: JumpSport, Inc., Saratoga, CA (US)

( * ) Notice: Subject to any disclaimer, the term of this patent is extended or adjusted under 35 U.S.C. 154(b) by 0 days.

(21) Appl. No.: 12/354,611

(22) Filed: Jan. 15, 2009

(65) Prior Publication Data

US 2009/0181827 A1 Jul. 16, 2009

Related U.S. Application Data

(60) Provisional application No. 61/021,603, filed on Jan. 16, 2008.

(51) Int. Cl.
*A63B 5/11* (2006.01)

(52) U.S. Cl. ..... 482/27; 482/28

(58) Field of Classification Search ..... 482/27, 482/28; 441/35, 40, 41, 42
See application file for complete search history.

(56) References Cited

U.S. PATENT DOCUMENTS

| | | | | |
|---|---|---|---|---|
| 3,037,218 | A * | 6/1962 | Brooks, III | 441/38 |
| 3,047,294 | A | 7/1962 | Maxwell | |
| 3,310,305 | A | 3/1967 | Howe | |
| 3,734,496 | A | 5/1973 | Rubin | |
| 4,576,375 | A | 3/1986 | Roberts | |
| 4,598,904 | A | 7/1986 | Roth | |
| 4,644,892 | A | 2/1987 | Fisher | |
| 4,836,530 | A | 6/1989 | Stanley | |
| 5,299,989 | A | 4/1994 | Boyd | |
| 5,385,518 | A | 1/1995 | Turner | |
| 5,462,505 | A | 10/1995 | Blair et al. | |
| 5,637,057 | A * | 6/1997 | Collura | 482/27 |
| 5,810,695 | A | 9/1998 | Sass | |
| 6,223,673 | B1 | 5/2001 | Mears | |
| 6,447,426 | B2 | 9/2002 | Peterson | |
| 6,508,682 | B1 | 1/2003 | Clark | |
| 6,554,753 | B1 | 4/2003 | Weck | |
| 6,582,264 | B2 | 6/2003 | Brown | |
| 6,659,914 | B2 | 12/2003 | Plante | |
| 6,773,355 | B1 | 8/2004 | Lekhtman | |
| 7,032,258 | B2 * | 4/2006 | O'Hanlon | 4/487 |
| 7,150,699 | B2 | 12/2006 | Yang | |
| 2003/0064861 | A1 | 4/2003 | Chen | |
| 2003/0104905 | A1 | 6/2003 | Publicover | |
| 2005/0037896 | A1 | 2/2005 | Publicover | |
| 2005/0148433 | A1 * | 7/2005 | Wang et al. | 482/27 |
| 2006/0189442 | A1 | 8/2006 | Publicover | |
| 2007/0271692 | A1 * | 11/2007 | Herd et al. | 4/499 |

* cited by examiner

*Primary Examiner*—Jerome Donnelly
(74) *Attorney, Agent, or Firm*—Edward S. Sherman, Esq.

(57) ABSTRACT

The trampoline with inflated base includes a generally toroidal shaped inflatable tube having an open center area. A mesh rebound member extends over the open center area and is secured around its entire periphery to the tube on the upper surface of the tube member. The tube includes a singular air duct or a plurality of air ducts extending radially which allow communication of air between the space interior to the tube and the space exterior to the tube.

20 Claims, 10 Drawing Sheets

TRAMPOLINE WITH INFLATED BASE

CROSS REFERENCE TO RELATED APPLICATIONS

The present application claims priority to the US provisional application, having Ser. No. 61/021,603 for a "Trampoline with Inflated Base", which was filed on Jan. 16, 2008, and which is incorporated herein by reference

BACKGROUND OF INVENTION

The present invention relates to recreational trampolines, and in particular trampolines having an inflated base so they are capable of floating on water.

Water trampoline devices are well known in the art. Examples of such water trampolines are shown in U.S. Pat. No. 4,576,375 to Roberts; U.S. Pat. No. 5,810,695 to Sass; and U.S. Pat. No. 7,150,699 to Roth, among others.

Typically, the devices include an inflatable tube in the shape of a ring or doughnut, but other variations include square or rectangular shapes. The device also includes a central rebounding or bed portion, which is typically a tightly woven mesh, and is connected around its outer periphery to the inflatable tube, typically near the top of the tube. This bed portion extends over the central opening of the tube wherein the mesh or a comparable elastic surface member forms the rebound member. Various securing/attaching elements are known to connect the rebound member and the tube, including rubber strands, such as shown in the '375 patent, or more typically, springs or bungee-type devices, such as shown in the '695 patent and in U.S. Pat. No. 5,385,518 to Turner. Generally, those devices having metal springs have a greater efficiency in absorbing and returning the energy of a jumper, and thus provide a higher performance bounce. The device is commonly referred to as a water trampoline because the inflatable tube can float on water, but may also be used on land if so desired.

However, such water trampolines are still inferior in rebounding efficiency to larger trampolines that are extended off the ground by a heavy metal frame.

It is therefore a first object of the present invention to provide a water trampoline of superior rebounding efficiency.

SUMMARY OF INVENTION

In the present invention, the first object is achieved by providing a trampoline with inflated base that comprises a generally toroidal shaped inflatable tube having an open center area, a rebound member configured to extend over the open center area of the inflatable tube, the rebound member providing a trampoline effect for a user when the rebound member is operatively secured to the tube. The tube includes a singular air duct or a plurality of air ducts extending radially between the central open area within the tube and the outside of the tube which allow communication of air between the space interior to the tube and the space exterior to the tube.

The above and other objects, effects, features, and advantages of the present invention will become more apparent from the following description of the embodiments thereof taken in conjunction with the accompanying drawings.

DETAILED DESCRIPTION

Figure 1:
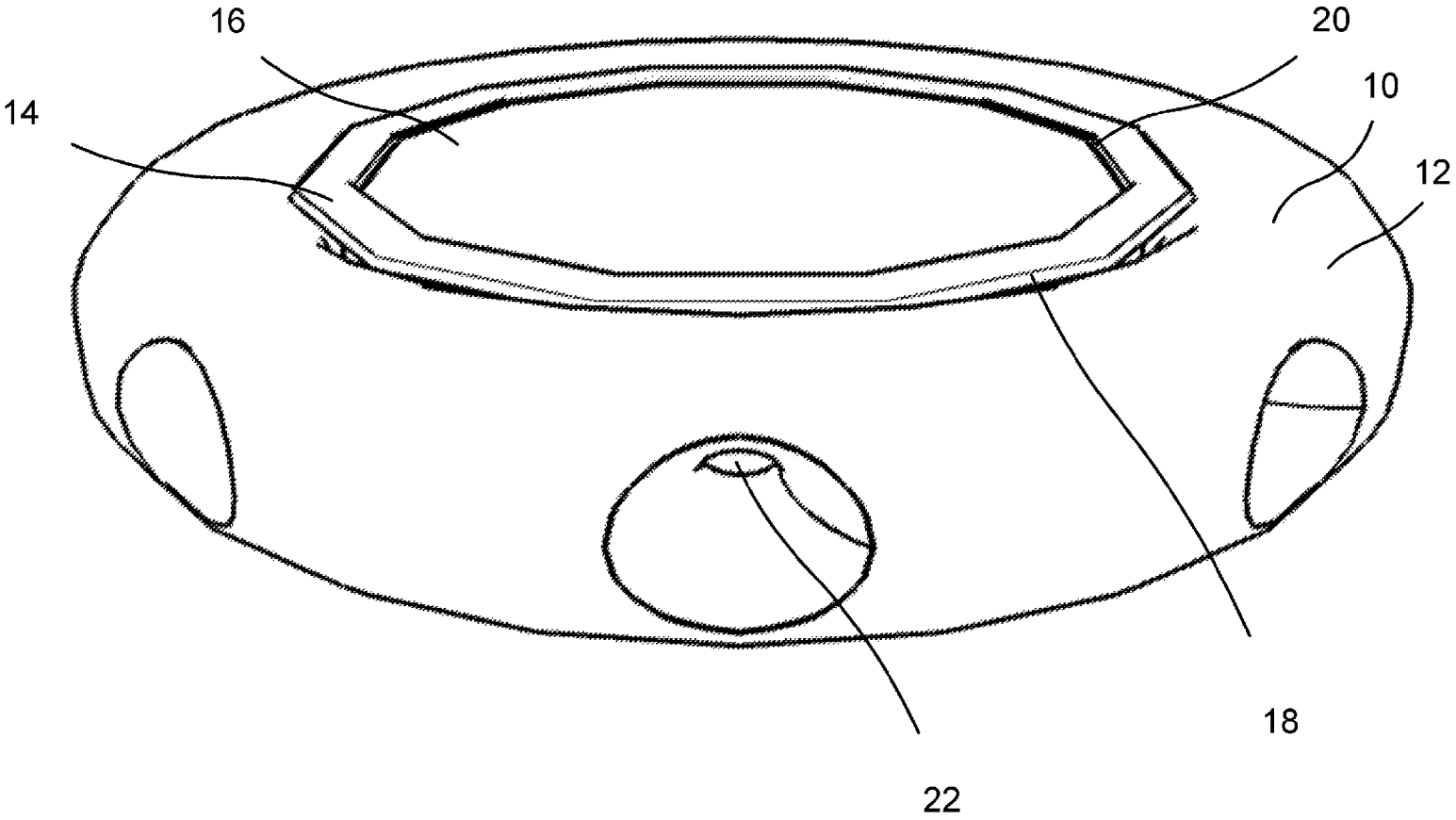
FIG. 1 is a perspective view of the trampoline of the present invention.

Referring to FIGS. 1 through 10, wherein like reference numerals refer to like components in the various views, there is illustrated therein a new and improved trampoline with inflated base, generally denominated 10 herein.

It has not been completed appreciated by those of ordinary skill in the art that another significant factor determining the performance of these rebounding devices is energy which is lost in the movement of the bed. One of the components of this factor include the density of the weave of the mesh fibers and how they restrict airflow as the bed moves up and down. Most recreational based trampolines utilize a bed with a relatively densely woven mesh, which greatly restricts airflow. Another component of bed performance is the ability for the surrounding air to move in the space directly above and below the bed. Normally the inflatable tube surrounding the periphery of the space below the bed is a confined closed space or chamber. Because of this, the bed must compress air in the chamber as it travels downward, and the bed must pull against a partial vacuum in the chamber as it travels back upward. The net effect on the bed is energy loss, which results in decreased bounce performance.

Figure 2:
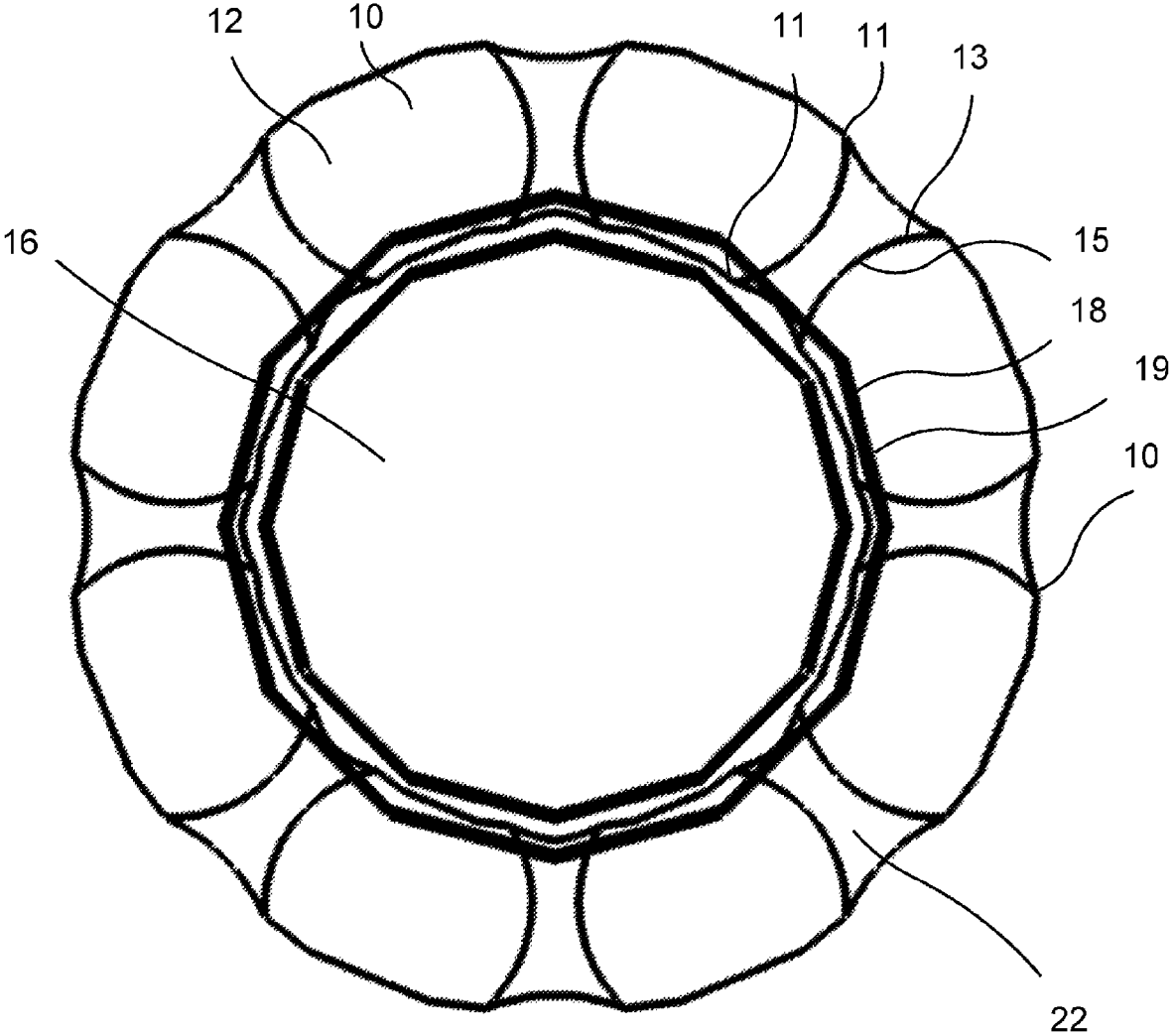
FIG. 2 is a plan view of the top and cross-section of the trampoline of FIG. 1.
Figure 3:
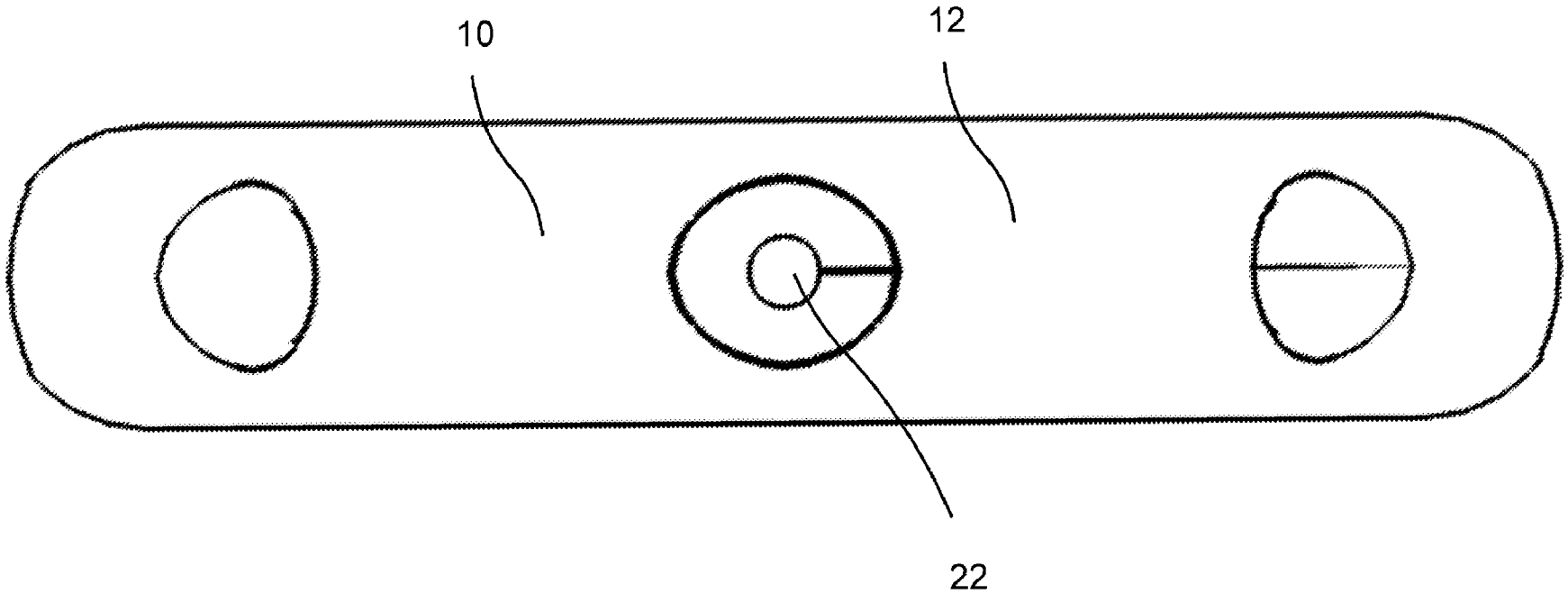
FIG. 3 is an elevational view of the front of the trampoline of FIG. 1.
Figure 4:
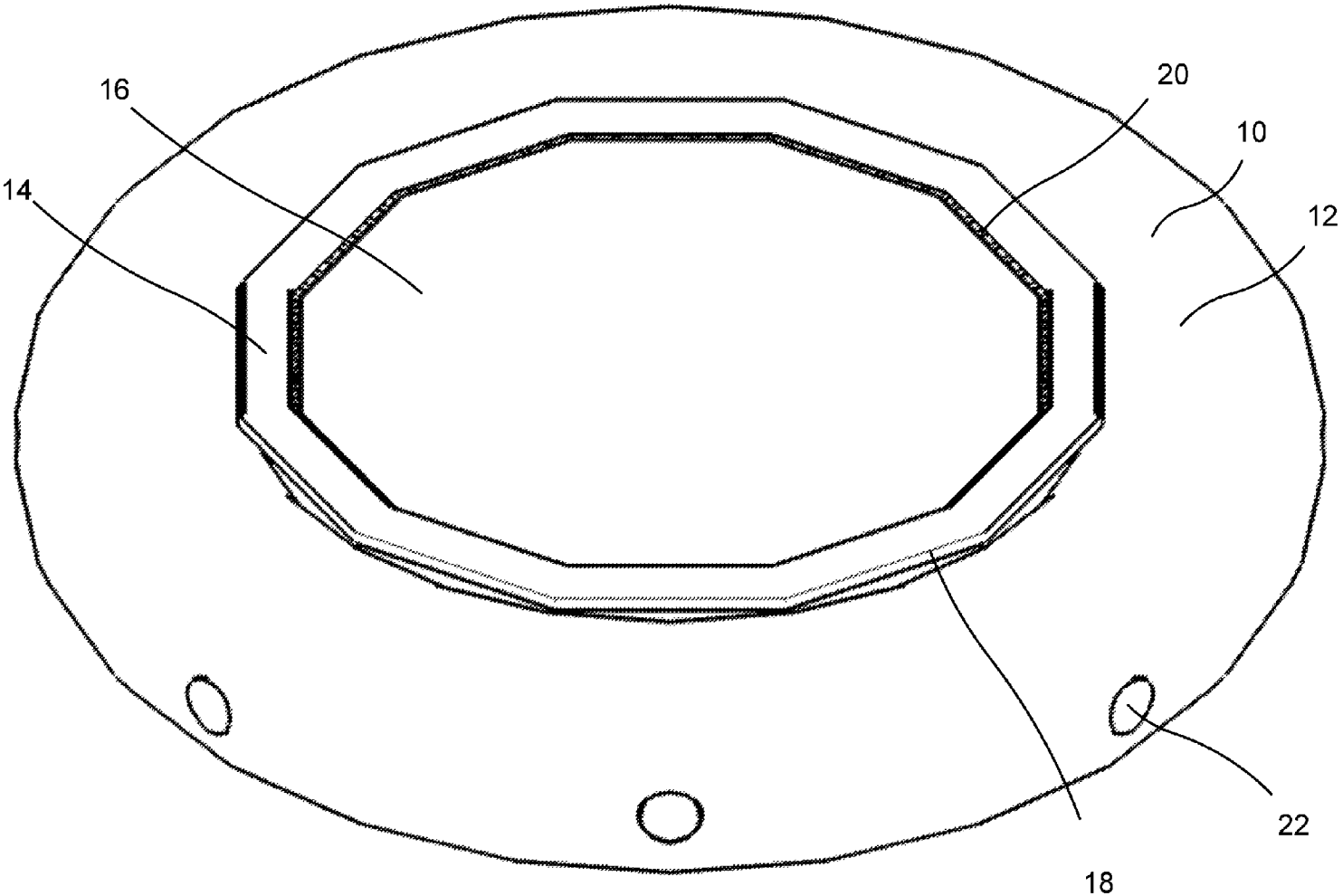
FIG. 4 is a perspective view of a second embodiment of the trampoline of the present invention.
Figure 5:
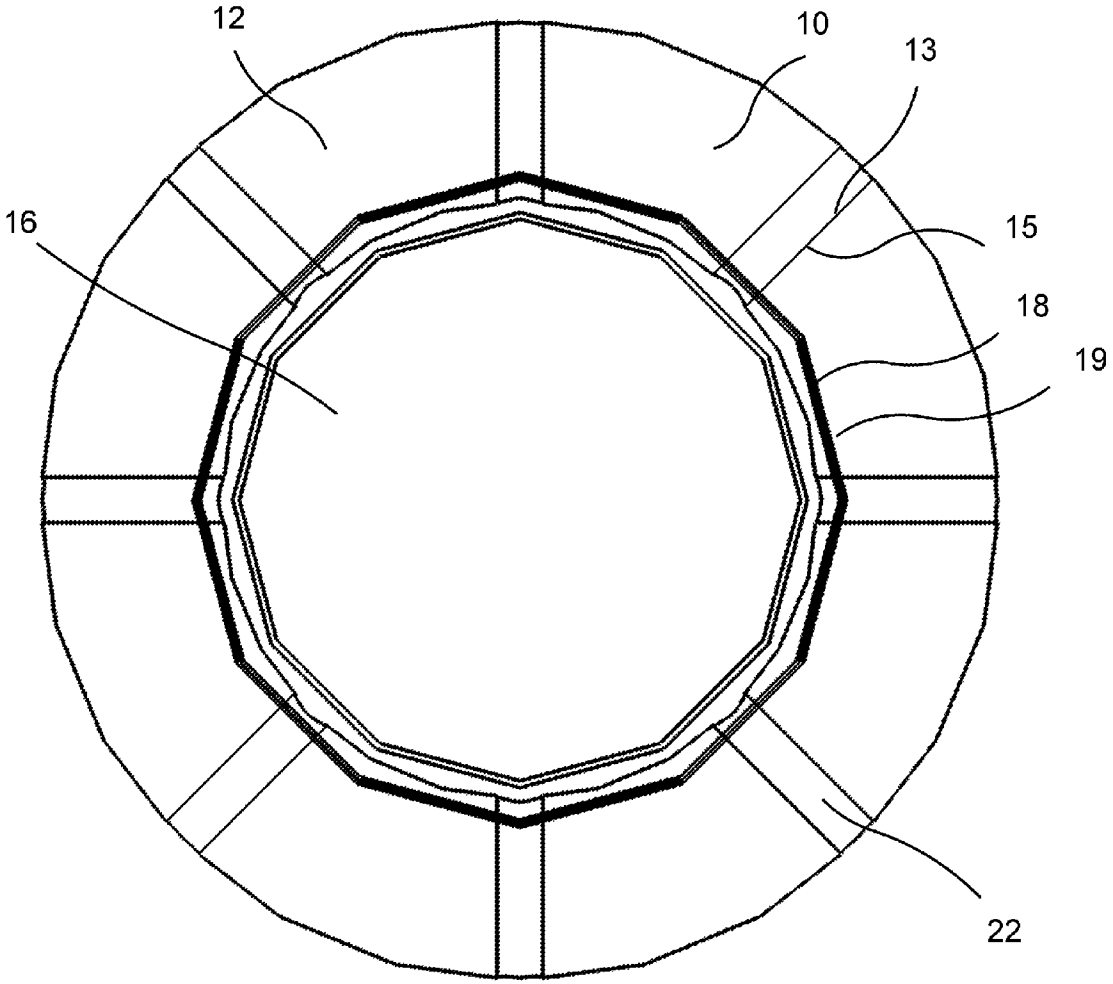
FIG. 5 is a plan view of the top and cross-section of the trampoline of FIG. 4.
Figure 6:
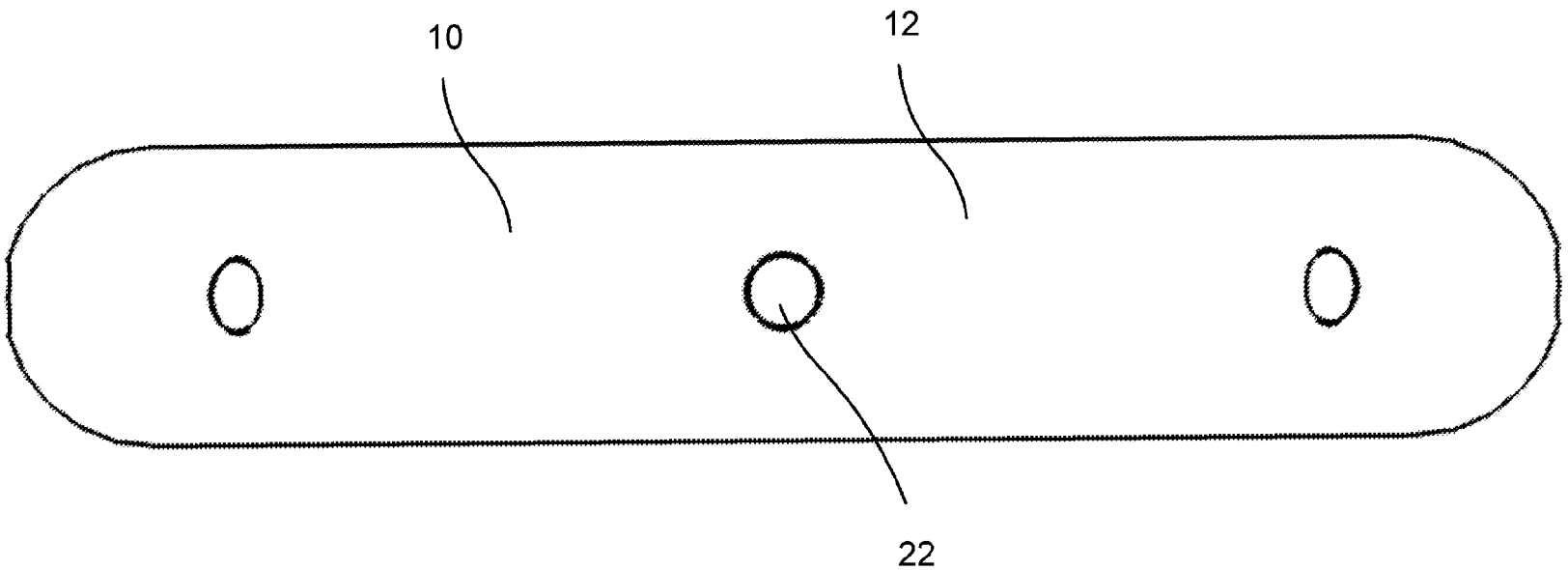
FIG. 6 is an elevational view of the front of the trampoline of FIG. 4.

In light of the foregoing discoveries and in accordance with the present invention it is desirable that a water trampoline has a vented lower chamber, to allow for greater airflow and increased bounce performance. FIGS. 1-3 show the complete water trampoline of an embodiment of the present invention in which water trampoline 10 includes an inflatable tube 12 in the shape of a toroid, which has a circular perimeter. Additional embodiments of the invention include tubes 12 with perimeter shape of a square, rectangle, pentagon, hexagon, octagon, decagon, or dodecagon. The tube 12 itself can be of various cross-sectional diameters; and the diameter of the toroid configuration can also vary. In one embodiment, the toroid has an outside diameter of 15 feet, while the tube has a cross-sectional diameter of approximately 3 feet. In the embodiment shown, tube 12 is 28 ounce 1000 denier polyester reinforced PVC material, which is a heavy-duty plastic and resistant to puncture. Again, however, different materials can be used.

At the upper surface portion of tube 12 is a resilient rebound element 16. In the embodiment shown, rebound element 16 is preferably a polypropylene mesh fabric, in the shape of a dodecagon, and covers the central opening of the toroidal tube at the upper surface thereof. In additional, rebound elements 16 and tube 10 may be configured in numerous shapes including, but not limited to, a hexagon, octagon, decagon, and a circle. The mesh material is well known and therefore not described in more detail.

In the embodiment shown, for a 15 foot toroidal tube, rebound element 16 is preferably about 10 feet in diameter. Rebound element 16 is sufficiently suspended by springs 20 attached to a frame 18 provide a trampoline effect when jumped on by a user. The frame 18 is secured along its outer peripheral edge 19 to the inflatable toroidal tube 12, near the upper or top edge of the tube 12.

Water trampoline 10 will typically, but not necessarily, include additional (accessory) elements not shown, including an anchor with an anchor rope attached to the tube 12. In one embodiment, the anchor rope is approximately 12 feet long and the anchor is a PVC bag with a 20-pound weight therein. Although not shown in the embodiment, water trampoline 10 may include at least one ladder, which extends downwardly into the water from inflatable tube 12 from attachment points on the outer periphery of the tube. A ladder can be made, for instance, of lengths of rope with horizontal wood slats or rods extending therebetween. The ladder is used by a swimmer to ascend onto the water trampoline.

In the embodiment shown, inflatable tube 12 has air ducts 22 which allow air to pass between the space interior to the inflatable tube and the space exterior to the inflatable tube. As shown, the ducts are channels with a generally circular cross section, arranged radially on the horizontal plane at the midpoint of the height of tube 12. Although the ducts of the preferred embodiment are have a generally circular cross section, ducts having rectangular, triangular, elliptical, or other cross sections may be used in alternative embodiments. When a user jumps and falls downward into rebounding surface 16, the rebounding surface travels downward. The volume of air contained in the space defined between the surface of the water and the rebounding surface 16 and within the inner diameter of toroidal tube 12 decreases as the rebound surface moves downward. Air is pushed out through the air ducts 22 to the ambient air exterior to the inflated tube 12. As the user bounces back upward, the rebounding surface travels upward. The volume of air contained in the space defined between the surface of the water and the rebounding surface 16 and within the inner diameter of toroidal tube 12 then increases as the rebounding surface moves upward. Air is drawn in through the air ducts 22 from the ambient air exterior to the inflatable tube. By allowing the air to travel through the ducts 22, the bed is able to move more rapidly and freely. This decreases the energy loss associated with the movement of the bed, thus increasing the bounce performance of the trampoline.

Because toroidal tube 12 is inflated, its internal pressure will naturally have a tendency to force the walls 13 of the ducts together at the midpoint if they are unsupported. This is clearly illustrated in the plan view shown in FIG. 2. Because of this effect, the ducts may be sized with a larger diameter at both ends 11 and the material of the inflated tube may be cut accordingly to provide a corresponding minimum diameter at the midpoint 15 through the toroidal tube.

In a second embodiment of the water trampoline shown in FIGS. 4-7 the ducts 22 maintain a circular cross section of consistent diameter along their length. This embodiment includes means of reinforcing the walls of the ducts to counteract the compressive forces applied by the internal pressure of inflated tube 12. The function of the ducts is similar to the embodiment shown in FIGS. 1-3. Air is allowed to travel through the ducts, thereby improving bounce performance as previously described. FIGS. 7A-D illustrate four different embodiments of wall reinforcement elements. FIG. 7A shows a cylindrical reinforcement tube 40 with a solid wall having exterior surface 42 and interior surface 44. Reinforcement tube 40 is inserted into duct 22 prior to inflation of the tube 12. As tube 12 is inflated, the internal air pressure within the tube forces duct wall 13 against the exterior surface of the reinforcement tube 42. The resulting friction between the two surfaces causes reinforcement tube 40 to be securely held in place. When installed, the inner surface 44 becomes the open duct which allows airflow between the inner and outer space of inflatable tube 12. The reinforcement embodiments shown in FIG. 7B-D may be installed in a similar manner.

Figure 7B:
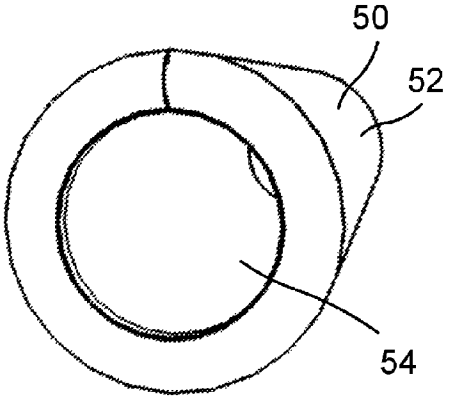
FIGS. 7A-D are four perspective views, each of a different embodiment of the air duct reinforcement.

FIG. 7B shows inflatable reinforcement tube 50 having outer surface 52 and inner surface 54. An uninflated reinforcement tube 50 is inserted into duct 12 and inflated to a pressure higher than inflatable tube 12. Inflatable tube 12 is then inflated as previously described. Because of the pressure is higher tube 50 than in tube 12, it is able to resist the inward forces of the duct wall 13.

Figure 7D:
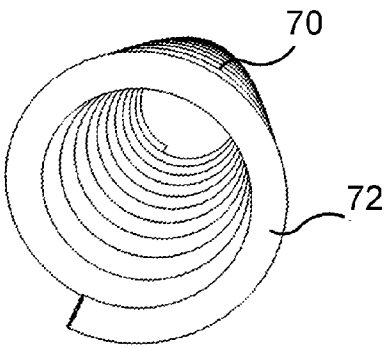
Figure 7A:
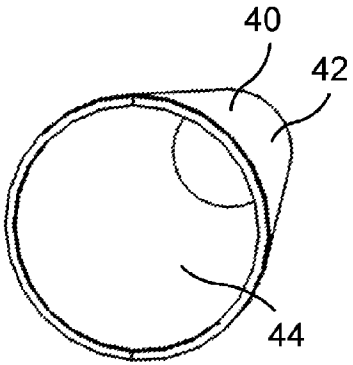
Figure 7C:
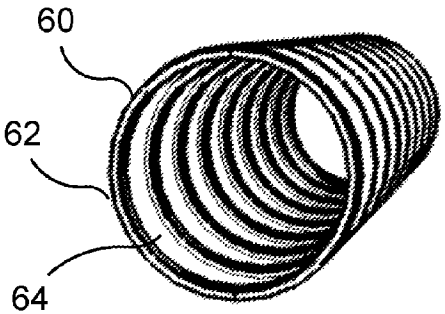

As shown in FIG. 7C, reinforcement tube 60 has a plurality of rigid annular support rings 62. The rings are connected by tubing material 64 which in the preferred embodiment is flexible. Alternate embodiments include the use of a rigid tubing material 64. FIG. 7D shows reinforcement tube 70 composed of helically wound rigid material 72.

Figure 8:
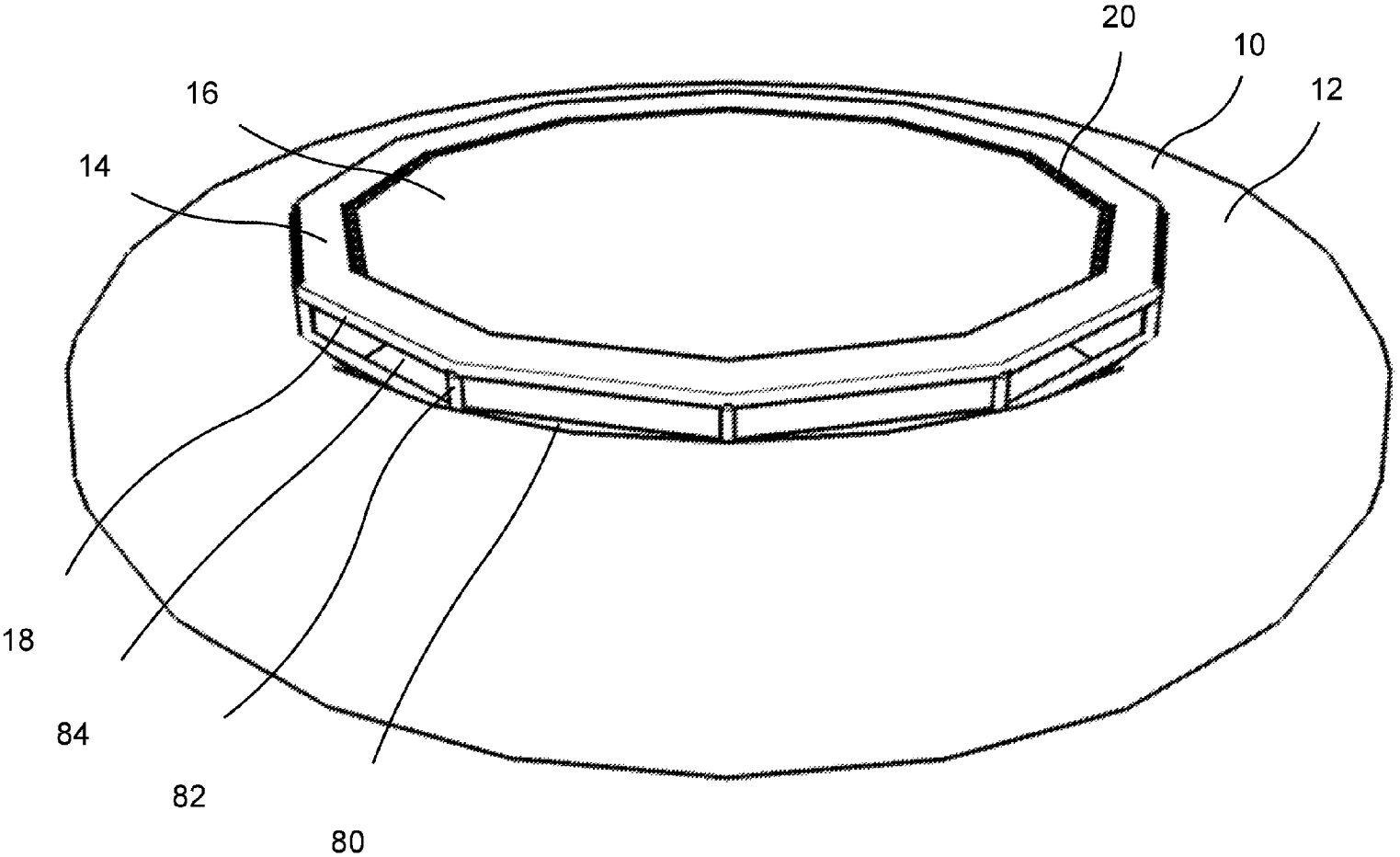
FIG. 8 is a perspective view of a third embodiment of the trampoline of the present invention.

FIG. 8 illustrates an alternative embodiment of the present invention. It utilizes an inflatable toroidal tube 12. Rebounding surface 16, springs 20 and upper frame 19 are supported by vertical supports 82 and lower frame 80. The separation between upper frame 19 and lower frame 80 create openings 84 between each vertical support 82 about the circumference of the frame. These openings 84 allow air to pass between the space interior to the inflatable tube and the space exterior to the inflatable tube. The function of these openings 84 is similar to the ducts 22 shown in the embodiment of FIGS. 1-3. Air is allowed to travel through the openings 84, thereby improving bounce performance as described in each of the previous embodiments. An additional variation of the invention which functions in an identical manner would be an inflated toroidal tube having diameter which varies in a pattern alternating between a maximum and a minimum diameter, such that the areas having the minimum diameter provide an openings between the tube and the lower frame 80 of the trampoline. The openings thus created provide a means for air to bass between the interior and the exterior of the inflatable tube as previously described.

Figure 9:
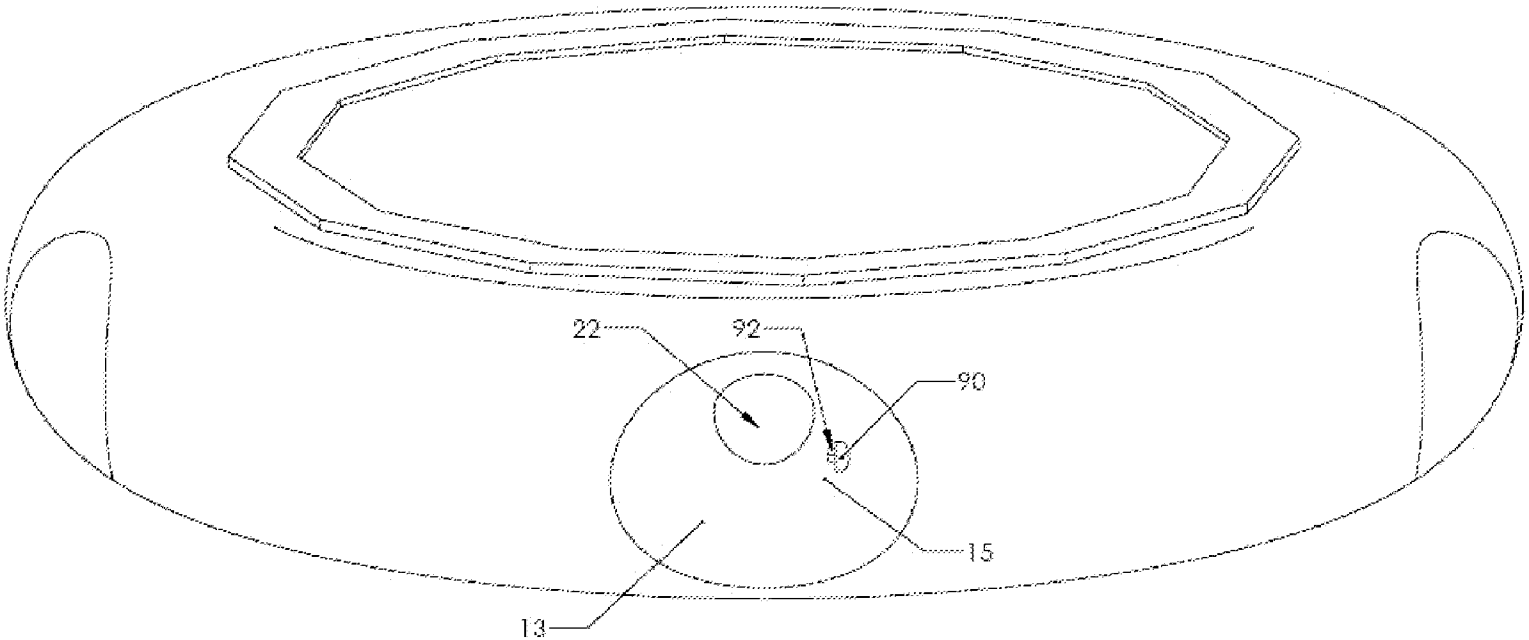
FIG. 9 is a perspective view of a trampoline of FIGS. 1-3 having an inflation valve feature.

An additional feature of the invention of FIG. 1-3 is shown in FIG. 9. Inflation valves are commonly used in the art for both inflation and deflation of inflatable devices. A disadvantage of these devices is that they are manufactured of rigid plastic material which may become damaged when the device is impacted, or may cause injury to users when they come in direct contact with the valve. The air ducts 22 afford additional advantages of durability and safety with respect to said inflation valves. The perspective view through air duct 22 illustrates inflation valve cap 92 and inflation valve seat 90. The valve is located on the wall 13 of the duct 22, at the midpoint 15 through the toroidal tube. This location of the inflation valve within the air duct 22 is advantageous in preventing damage to the valve as a result of impact during use or transportation of the invention. In addition, because its location is removed from the areas of the device that users will conduct their activities, this valve location prevents bodily injury through inadvertent contact.

Figure 10:
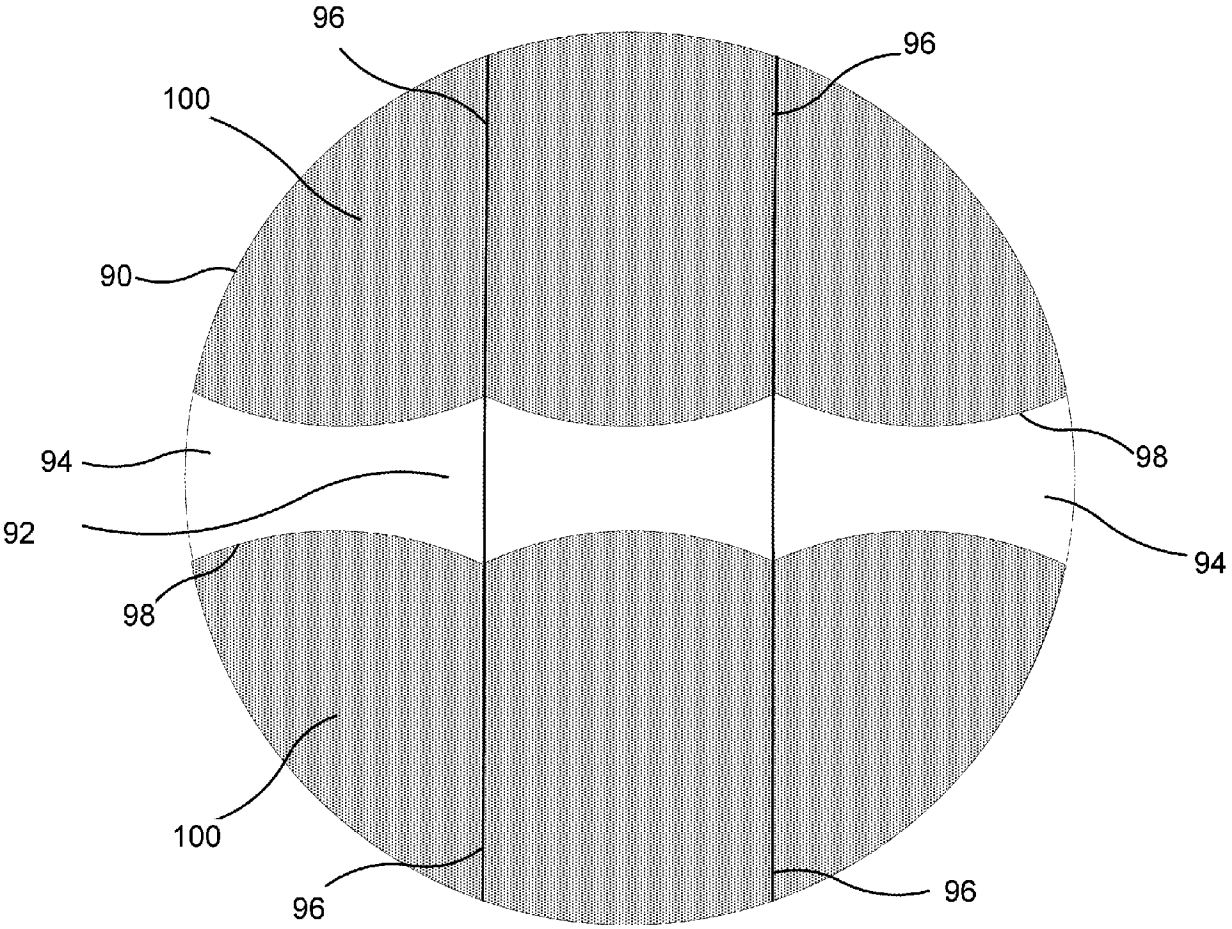
FIG. 10 is a cross-sectional view of the inflated base for the trampoline showing the air duct.

FIG. 10 shows a cross sectional view of an alternative means of construction to those shown in FIGS. 7A-D. The toroidal tube outer wall 90 has openings 94 for air duct 92, which is defined by duct wall 98. Duct wall 98 is supported by vertical walls 96, which prevent the duct from collapsing inward under pressure from inflated chamber 100. Note that vertical walls as viewed from above form concentric rings which are internal to toroidal tube outer wall 90.

Thus, the disadvantages of poor performance, poor durability, and poor safety seen in prior art water trampolines are corrected by the present invention through the use of the novel features previously described.

While the invention has been described in connection with various preferred embodiments, it is not intended to limit the scope of the invention to the particular forms set forth, but on the contrary, it is intended to cover such alternatives, modifications, and equivalents as may be within the spirit and scope of the invention as defined by the appended claims.

We claim:

1. A trampoline with inflated base, comprising:

a) an inflatable tube having an open center area that is open at the bottom;

b) a rebound member configured to extend over the open center area of the inflatable tube, the rebound member providing a trampoline effect for a user when the rebound member is operatively secured to the tube;

c) wherein the tube includes at least one air duct extending radially through the tube between the space interior to the tube and the space exterior to the tube allowing air to flow there between in response to movement of the rebound member, wherein the air duct is surrounded by the tube.

2. The trampoline with inflated base of claim 1, wherein the duct is circular in shape.

3. The trampoline with inflated base of claim 2, wherein the duct is reinforced by a solid wall tubular member.

4. The trampoline with inflated base of claim 2, wherein the duct is reinforced by an inflatable wall tubular member.

5. The trampoline with inflated base of claim 4, wherein the inflatable wall tubular member is inflated to a pressure higher than that of the inflatable tube having an open central area.

6. The trampoline with inflated base of claim 2, wherein the duct is reinforced by a single annular ring.

7. The trampoline with inflated base of claim 2, wherein the duct is reinforced by a plurality of annular rings.

8. The trampoline with inflated base of claim 2, wherein the duct is reinforced by a helically wound support member.

9. The trampoline with inflated base of claim 2, wherein the duct is unreinforced, and the diameter of each end of the duct is sized such that a minimum diameter is achieved at the midpoint of the duct.

10. The trampoline with inflated base of claim 1, wherein an inflation valve is located within the air duct.

11. A trampoline with inflated base, comprising:

a) an inflatable tube having an open center area, b) a rebound member configured to extend over the open center area of the inflatable tube, the rebound member providing a trampoline effect for a user when the rebound member is operatively secured to the tube;

c) wherein the tube includes at least one air duct extending radially between the space interior to the tube and the space exterior to the tube allowing air to flow there between in response to movement of the rebound member, d) wherein the duct is reinforced by an inflatable wall tubular member.

12. The trampoline with inflated base of claim 11, wherein the inflatable wall tubular member is inflated to a pressure higher than that of the inflatable tube having an open central area.

13. A trampoline with an inflated base, comprising:

a) an inflatable tube having an open center area;

b) a rebound member configured to extend over the open center area of the inflatable tube, the rebound member providing a trampoline effect for a user when the rebound member is operatively secured to the tube;

c) wherein the tube includes at least one reinforced air duct extending radially between the space interior to the tube and the space exterior to the tube allowing air to flow there between in response to movement of the rebound member wherein the at least one duct is reinforced by a helically wound support member.

14. The trampoline with inflated base of claim 1, wherein the tube includes a plurality of air ducts extending radially between the space interior to the tube and the space exterior to the tube allowing air to flow there between in response to movement of the rebound member, wherein each air duct is surrounded by the tube.

15. The trampoline with inflated base of claim 14, wherein the plurality of ducts are circular in shape.

16. The trampoline with inflated base of claim 14, wherein the plurality of ducts are reinforced by a solid wall tubular member.

17. The trampoline with inflated base of claim 14, wherein the plurality of ducts are reinforced by an inflatable wall tubular member.

18. The trampoline with inflated base of claim 14, wherein the plurality of ducts are reinforced by a second inflatable wall tubular member which is inflated to a pressure higher than that of said inflatable tube.

19. The trampoline with inflated base of claim 14, wherein each of the plurality of ducts are reinforced by at least a single annular ring.

20. The trampoline with inflated base of claim 14, wherein the plurality of ducts are reinforced by a helically wound support member.

* * * * *